United States Patent [19]

Pritchard

[11] 3,935,656

[45] Feb. 3, 1976

[54] PICTURE FRAME SYSTEM

[76] Inventor: William Stratton Pritchard, 201 Avery Drive NE., Atlanta, Ga. 30309

[22] Filed: May 17, 1974

[21] Appl. No.: 470,824

[52] U.S. Cl. ..... 40/155

[51] Int. Cl.[2] ..... G09F 1/12

[58] Field of Search ..... 40/152.1, 155, 156, 152; 248/488, 490

[56] References Cited

UNITED STATES PATENTS

| | | | |
|---|---|---|---|
| 412,953 | 10/1889 | Gale | 40/152.1 |
| 1,212,422 | 1/1917 | Thomas | 248/490 |
| 3,541,714 | 11/1970 | Bruck | 40/156 |
| 3,798,815 | 3/1974 | Ward | 40/156 |

*Primary Examiner*—Hugh R. Chamblee
*Assistant Examiner*—Wenceslao J. Contreras
*Attorney, Agent, or Firm*—Jones, Thomas & Askew

[57] ABSTRACT

A frame system for mounting a sheet-like article such as a photograph or the like for display, including a front transparent sheet and a backing layer in superposed relation and between which the sheet-like article is held. Holding the composite structure firmly together are a number of clips which are attached to a rod structure positioned on the underside of the backing sheet and which extend around and hold the edges of both the transparent sheet and the backing layer.

1 Claim, 6 Drawing Figures

PICTURE FRAME SYSTEM

BACKGROUND OF THE INVENTION

One of the most conventional methods of mounting a sheet-like article such as a photograph for display involves the use of a conventional picture frame. Such a mounting system includes a transparent sheet of material, usually glass, within a wood or metal frame which extends around the periphery of the transparent sheet material. There is usually a support sheet also within the frame behind the transparent sheet. The sheet-like article is placed between the transparent sheet and the support sheet in such a way that the sheet-like article can be viewed through the transparent sheet and the transparent sheet, sheet-like article, and support sheet are normally held within the frame by tape which is applied to the back of the frame and support sheet.

An alternative manner of mounting such a sheet-like article which is less expensive and which produces a different aesthetic effect from the conventional picture frame involves mounting the sheet-like article between a transparent sheet and a backing sheet and holding the composite structure together with individual clips or other suitable holding pieces which fit around the edges of the composite structure. One of the problems normally encountered with clips presently used is that the clips fail to hold the composite structure firmly together and the sheet-like material slips out of its position with respect to the transparent sheet. Another problem attendant on the use of individual clips is that they are easily dislodged from the edges of the composite structure, as a result of which the composite structure may come apart. Still another problem attendant on the use of such clips is that the clips have to be individually centered along the edges of the composite structure.

SUMMARY OF THE INVENTION

Briefly described, the present invention is directed to a frame system for mounting a sheet-like article such as a photograph or the like for display comprising an outer transparent sheet and a backing layer. The sheet-like article is positioned between the outer transparent sheet and the backing layer in such a way that the representation on the sheet-like article to be displayed can be viewed through the outer transparent sheet. A number of clips extend around and hold each of the edges of the composite structure formed by the outer transparent sheet, sheet-like article, and backing layer. The clips are secured to a rod structure positioned on the underside of the backing layer and the rod structure comprises several rods which are resilient and exert a pulling force on the clips to insure a firm holding action by the clips on the composite structure.

Thus, it is an object of the present invention to provide a frame system for mounting a sheet-like article in which the sheet-like article is held firmly in position.

It is another object of the present invention to provide a frame system for mounting a sheet-like article which is easily disassembled and assembled to provide easy removal of the sheet-like article and substitution of a different one.

It is still another object of the present invention to provide a frame system for mounting a sheet-like article which is easily hung for display by any of its edges.

These and other objects, features, and advantages of the present invention will become apparent from reading the following specification, when taken in conjunction with the accompanying drawing, depicting an illustrative embodiment of the invention.

DESCRIPTION OF THE PREFERRED EMBODIMENT

Figure 1:
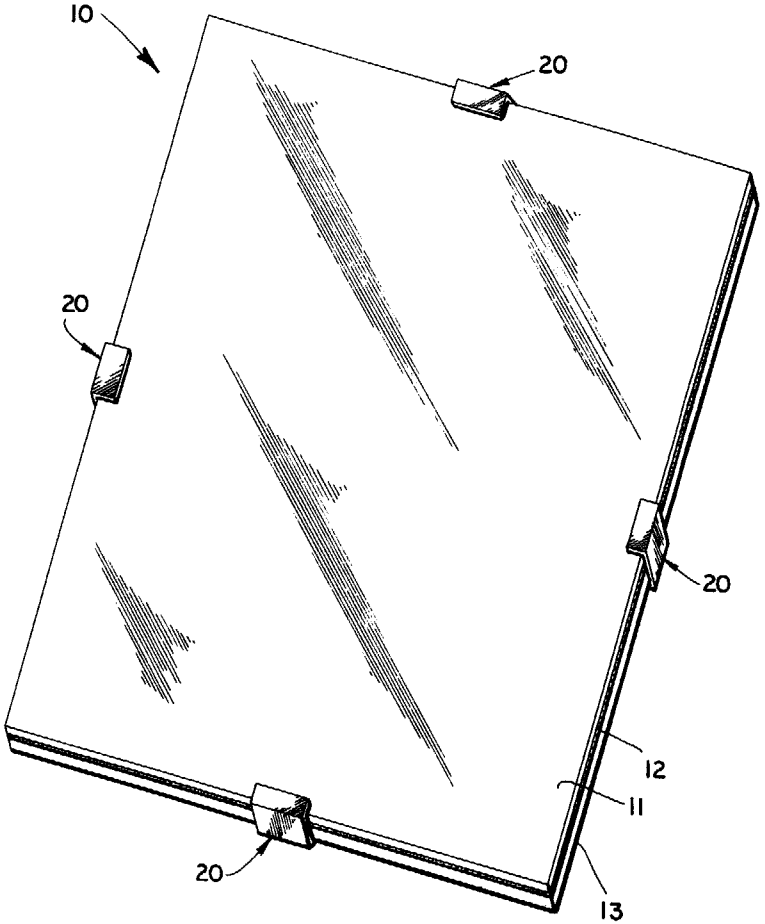
FIG. 1 is a frame system for mounting a sheet-like article according to the disclosed illustrative embodiment of the present invention.

Referring now in more detail to the drawings, in which like numerals indicate like parts throughout the several views, FIG. 1 shows frame system 10. Frame system 10 includes front transparent sheet 11, sheet-like article 12, and backing layer 13 held together as a composite structure in superposed relation by clips 20.

Transparent sheet 11 is preferably constructed from either glass or some conventional synthetic plastic, such as methyl methacrylate polymers and the like, but any conventional transparent construction material in sheet form with sufficient rigidity and strength can be used as transparent sheet 11. Sheet-like article 12 is a photograph, picture, certificate, menu, or other similar item suitable for mounting for display purposes. Although sheet-like article 12 is depicted in the figures as having the same length and width as transparent sheet 11 and backing layer 13, it is desirable to have sheet-like article 12 with smaller dimensions. Sheet-like article 12 can then be centered with respect to the edges of transparent sheet 11 to provide a border around the edges of sheet-like article 12. Backing layer 13 is preferably constructed from a sheet of stiff paper, but other materials, such as glass, plastic, wood, and metal, can be utilized in preparing backing layer 13. Backing layer 13 can either be transparent or opaque but preferably backing layer 13 is opaque in order to prevent the rod structure 14 from being seen during display of sheet-like article 12. If sheet-like article 12 is centered within the frame system 10 with a border extending around the edges of sheet-like article 12, a colored backing layer 13 can be selected in accordance with the colors present in sheet-like article 12.

Figure 2:
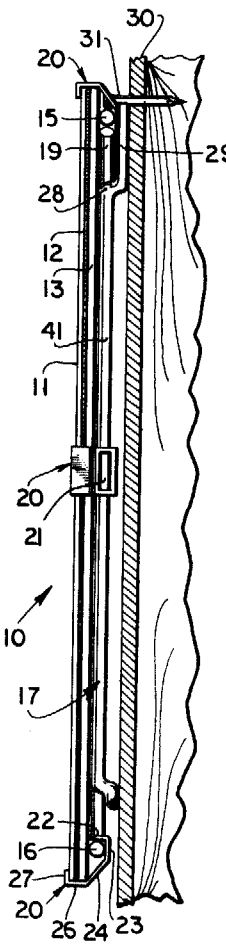
FIG. 2 is a side view of the frame system of FIG. 1, with the lower end of the left vertical frame rod and the right vertical frame rod broken away.

Each of the clips 20 which hold the transparent sheet 11, sheet-like article 12, and backing layer 13 firmly together is bent at various locations as depicted in the lower portion of FIG. 2 to provide numerous flat surfaces at various angles to the longitudinal axis of each clip 20. Clip 20 includes a first flange 27 and a first leg 26 at an angle slightly greater than 90° with respect to each other with first flange 27 being in contact with the front of transparent sheet 11 at the edge. First leg 26 is in direct contact with and supports the edges of transparent sheet 11, sheet-like article 12, and backing layer 13. Extending at an angle from first leg 26 away from the edges of backing layer 13 and towards the center of backing layer 13 is angular leg portion 24 which has an opening 21 therethrough. Extending from angular leg portion 24 at an angle and parallel to first flange 27 is central leg portion 23. Clip 20 terminates in a second flange 22 which extends from central leg portion 23 at an angle of approximately 90° and towards the back of backing layer 13.

Figure 3:
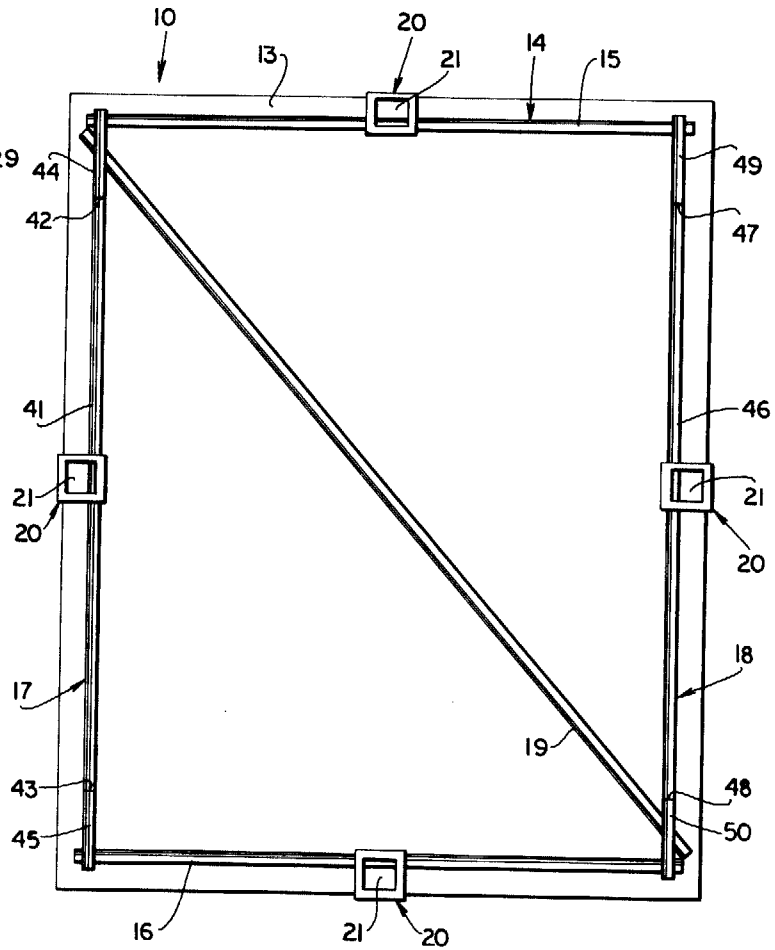
FIG. 3 is a rear view of the frame system of FIG. 1.

Viewing the back of frame system 10 as in FIG. 3, clips 20 are attached to top horizontal frame rod 15, bottom horizontal frame rod 16, left vertical frame rod 17 and right vertical frame rod 18 which, together with diagonal brace rod 19, comprise rod structure 14. Each of rods 15, 16, 17 and 18 extends through the angular space defined by the central leg portion 23 and the second flange 22 of clip 20 with the circumference of each rod being in contact with the central leg portion 23 and the second flange 22. Although there is only one clip 20 centrally positioned along the length of each of top horizontal frame rod 15, bottom horizontal frame rod 16, left vertical frame rod 17, and right vertical frame rod 18 in accordance with the preferred embodiment of the invention as depicted in FIG. 3, it is within the scope of the invention to have two or more clips 20 securely attached to each rod.

Each of top horizontal frame rod 15, bottom horizontal frame rod 16, left vertical frame rod 17, and right vertical frame rod 18 is spaced a predetermined distance from and essentially parallel to the top, bottom, left, and right edges, respectively, of transparent sheet 11 and backing layer 13. Both top horizontal frame rod 15 and bottom horizontal frame rod 16, as well as diagonal brace rod 19, are essentially straight and lie in a plane immediately adjacent backing layer 13. Left vertical frame rod 17 has an essentially straight section 41 which also lies in the plane immediately adjacent backing layer 13. Near the top end of left vertical frame rod 17 the rod bends outward from backing layer 13 at a 90° angle at 42 and immediately thereafter upward at a 90° angle to provide upper end section 44 which is parallel to straight section 41. The left ends of top horizontal frame rod 15 and diagonal brace rod 19 extend between backing layer 13 and upper end section 44 and are secured to upper end section 44. Near the bottom end of left vertical frame rod 17 is a similar double 90° bend at 43 to provide lower end section 45 which is parallel to straight section 41. Similarly, the left end of bottom horizontal frame rod 16 extends between backing layer 13 and lower end section 45 and is secured to lower end section 45. Right vertical frame rod 18 is identical in shape to left vertical frame rod 17 with a straight section 46, two double 90° bends 47 and 48, an upper end section 49, and a lower end section 50. Between upper end section 49 and backing layer 13 and secured to upper end section 49 is the right end of top horizontal frame rod 15, and between lower end section 50 and backing layer 13 and secured to lower end section 50 are the right ends of bottom horizontal frame rod 16 and diagonal brace rod 19.

Preferably, the clips 20 and the rods within rod structure 14 are resilient steel, although construction materials such as plastic and metals other than steel could be used in forming these elements. By having all these elements constructed of the same material, it is much easier to secure them with one another at points of contact. For instance, if the clips 20 and the rods are steel, they can be permanently secured to one another by spotwelding. If all these elements are plastic, the elements can either be initially molded as a unit or suitable cements can be used to permanently secure the elements to each other. Although it is possible to permanently secure the clips 20 and the rods within rod structure 14 to one another, it is equally desirable to provide means such as screws or the like for securing these elements in some non-permanent manner. In this way, the frame system 10 can be disassembled for transporting, the clips 20 can be repositioned on the rods within the rod structure 14, and additional clips 14 can be easily added to rod structure 14.

In assembling the frame system 10 in accordance with the present invention a sheet-like article 12 such as a photograph is placed on backing layer 13 with the representation to be displayed facing away from the backing layer 13. Next, transparent sheet 11 is placed over sheet-like article 12 to form a composite structure. One of the clips 20 secured to rod structure 14 is then extended around the composite structure. The other clips 20 are successively extended around the composite structure by flexing the rods within the rod structure 14 outwardly towards the edges of the composite structure to allow the clips 20 to be extended around the edges. The resilient steel rods tend to return to their pre-flexed position and, by doing this, tend to pull all the clips away from the edges and towards the center of the composite structure. Preferably, the composite structure has dimensions which result in the rods not completely returning to this pre-flexed position but instead remain slightly bowed. This slightly bowed position of the rods will insure a constant pulling force on the clips 20, resulting in the composite being held firmly together.

After assembly the frame system 10 can be hung on a wall 30 for display by inserting a nail 31 or other similar securing instrument through the opening 21 in one of clips 20.

While this invention has been described in detail, with particular reference to a preferred embodiment thereof, it will be understood that variations and modifications can be effected within the spirit and scope of the invention as described hereinbefore and as defined in the appended claims.

I claim:

1. A frame system for mounting a sheet-like article such as a photograph or the like comprising a front transparent sheet through which the sheet-like article is viewed; a backing layer superposed on and substantially coextensive with said transparent sheet, said photograph being between said transparent sheet and said backing layer; a first pair of resilient rods, each rod of said first pair of rods lying against said backing sheet adjacent to an edge of said backing sheet, the two rods of said first pair of rods being adjacent to opposed edges of said backing sheet; a first pair of clips, each clip of said first pair of clips being fixed to one of said first pair of rods, said each clip being so constructed and arranged that said transparent sheet and said backing layer are received within said clip while said resilient rod is lying against said backing sheet, each of said resilient rods tending to bow away from said backing layer generally at the mid portion of said resilient rods; a second pair of resilient rods, each rod of said second pair of rods lying adjacent to an edge of said backing layer substantially perpendicular to said first pair of rods, each rod of said second pair of rods including an end section to overlie one rod of said first pair of rods; a second pair of clips, one clip of said second pair of clips being fixed to each rod of said second pair of rods and adapted to receive said transparent sheet and said backing layer therein; and a brace rod, said brace rod extending diagonally across said backing layer, each end of said brace rod being received within one of said end sections of said second pair of rods.

* * * * *